US008922378B2

(12) United States Patent
Raccio

(10) Patent No.: US 8,922,378 B2
(45) Date of Patent: Dec. 30, 2014

(54) DISPENSING AND ACCOUNTABILITY SYSTEM AND METHOD FOR ASSURING WASHING OF HANDS

(71) Applicant: BAE Systems Information and Electronic Systems Integration Inc., Nashua, NH (US)

(72) Inventor: Alfred C. Raccio, Litchfield, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 14/120,215

(22) Filed: May 5, 2014

(65) Prior Publication Data

US 2014/0240131 A1 Aug. 28, 2014

Related U.S. Application Data

(63) Continuation-in-part of application No. 12/866,312, filed as application No. PCT/US2009/065831 on Nov. 25, 2009, now abandoned.

(60) Provisional application No. 61/120,133, filed on Dec. 5, 2008.

(51) Int. Cl.

| | |
|---|---|
| ***G08B 23/00*** | (2006.01) |
| ***G08B 21/24*** | (2006.01) |
| ***A47K 5/12*** | (2006.01) |

(52) U.S. Cl.

CPC ..... *G08B 21/245* (2013.01); *A47K 5/1217* (2013.01)

USPC ..... 340/573.1; 340/540

(58) Field of Classification Search

CPC ..... G08B 21/245; A47K 5/1217

USPC ..... 340/500, 540, 573.1

See application file for complete search history.

(56) References Cited

U.S. PATENT DOCUMENTS

| | | | |
|---|---|---|---|
| 5,945,910 | A | 8/1999 | Gorra |
| 6,279,777 | B1 | 8/2001 | Goodin et al. |
| 2004/0090333 | A1 | 5/2004 | Wildman et al. |
| 2006/0231568 | A1 | 10/2006 | Lynn et al. |

*Primary Examiner* — Albert Wong
*Assistant Examiner* — Sara Samson
(74) *Attorney, Agent, or Firm* — Daniel J. Long

(57) ABSTRACT

A dispensing and accountability system for assuring washing of a person's hands includes at least one passive infrared detector adapted to detect the presence of the person having a requirement of washing the hands. Further, the dispensing and accountability system includes a controller having a scalable processor architecture operatively coupled to each passive infrared detector of the at least one passive infrared detector. Furthermore, the dispensing and accountability system includes at least one audio signal unit operatively coupled to the controller. The at least one audio signal unit is adapted to generate an audio signal to remind the person to wash the hands. In addition, the dispensing and accountability system includes at least one dispensing unit operatively coupled to the controller. Because of the scalable processor architecture of the controller, the system may be expanded or contracted depending on the needs of the institution using it.

19 Claims, 6 Drawing Sheets

DISPENSING AND ACCOUNTABILITY SYSTEM AND METHOD FOR ASSURING WASHING OF HANDS

RELATED APPLICATIONS

This Application is a continuation-in-part from U.S. application Ser. No. 12/866,312 filed Aug. 5, 2010 which claimed rights under 35 USC §371 from application PCT/US2009/065831 filed Nov. 25, 2009 which claimed rights under 35 USC §119(e) from U.S. Application Ser. No. 61/120,133 filed Dec. 5, 2008, the contents of which are incorporated herein by reference.

FIELD OF THE DISCLOSURE

The present disclosure generally relates to systems and methods for assuring washing of hands. More particularly, the present disclosure relates to a dispensing and accountability system and a method for assuring proper washing of a person's hands.

BACKGROUND OF THE DISCLOSURE

In industries such as healthcare, an effective washing of hands of persons such as healthcare workers is the need of the hour. Further, it is well-known that infectious diseases, including nosocomial infections, may easily spread as a result of the inadvertent failure of the healthcare workers to properly wash their hands before and/or after conducting examinations on or procedures on patients.

Accordingly, various systems and methods have been devised for assuring hand washing by the healthcare workers. For example, various electro-mechanical devices have been designed to prevent spreading of diseases by hands of healthcare workers and others due to improper and incomplete hand washing. Such devices are known to establish a time reference for the healthcare workers to insure hand washing at specific time periods. Further, warning systems that are adapted to warn a healthcare worker to wash his/her hands prior to leaving or entering a facility in which hand washing is essential, have been developed. In addition, various other methods and apparatuses for assuring hand washing have been further devised where the hands of a healthcare worker may be marked with an identifiable substance after conducting a particular task, such as using a toilet. Moreover, many individualized hand washing agent dispensers have been developed that may be worn by healthcare workers outside their clothing.

However, many of the conventional systems and methods are incapable of washing and cleaning hands of healthcare workers in an effective manner. Also, most of the conventional systems have a complex configuration and are associated with methods that are difficult-to-use for communicating a healthcare worker about washing of his/her hands at appropriate time periods. Further, the conventional systems and methods are incapable of efficiently maintaining an account about the number of times a healthcare worker being monitored/targeted is required to wash his/her hands.

Accordingly, there is a need for a system that assures proper hand washing, and an effective accounting of information with regard to washing of hands of a person being monitored. Further, there is a need for a reliable and an easy-to-use method for assuring proper washing of a person's hands by communicating the need of washing the hands to the person.

SUMMARY OF THE DISCLOSURE

In view of the foregoing disadvantages inherent in the prior art, the general purpose of the present disclosure is to provide a dispensing and accountability system and a method for assuring washing of a person's hands, to include all advantages of the prior art, and to overcome the drawbacks inherent in the prior art.

An object of the present disclosure is to provide a dispensing and accountability system that assures proper washing of hands of a person being monitored and an effective accounting of information with regard to the washing of the hands.

Another object of the present disclosure is to provide a reliable and an easy-to-use method that assures proper washing of a person's hands by communicating the need of washing the hands to the person.

To achieve the above objects, in an aspect of the present disclosure, a dispensing and accountability system for assuring washing of a person's hands is disclosed. The dispensing and accountability system includes at least one passive infrared detector adapted to detect the presence of the person having a requirement of washing the hands. The dispensing and accountability system further includes a controller operatively coupled to each passive infrared detector of the at least one passive infrared detector for receiving and accounting a first set of information from the each passive infrared detector. The first set of information relates to detection of the presence of the person. Furthermore, the dispensing and accountability system includes at least one audio signal unit operatively coupled to the controller. The at least one audio signal unit is adapted to generate an audio signal to remind the person to wash the hands. The audio signal is generated when the presence of the person is detected by the at least one passive infrared detector.

In addition, the dispensing and accountability system includes at least one dispensing unit operatively coupled to the controller, such that the controller is capable of receiving and accounting a second set of information from the at least one dispensing unit. The second set of information relates to a response of the person when reminded of washing the hands. Each dispensing unit of the at least one dispensing unit includes a reservoir for storing a cleansing fluid and adapted to dispense the cleansing fluid from the reservoir onto the hands of the person when the person activates the each dispensing unit on being reminded.

Further, in another aspect of the present disclosure, a method for assuring washing of a person's hands is disclosed. The method includes providing a dispensing and accountability system. The dispensing and accountability system includes at least one passive infrared detector adapted to detect the presence of the person having a requirement of washing the hands. The dispensing and accountability system further includes a controller operatively coupled to each passive infrared detector of the at least one passive infrared detector for receiving and accounting a first set of information from the each passive infrared detector. The first set of information relates to detection of the presence of the person. Furthermore, the dispensing and accountability system includes at least one audio signal unit operatively coupled to the controller. The at least one audio signal unit is adapted to generate an audio signal to remind the person to wash the hands. The audio signal is generated when the presence of the person is detected by the at least one passive infrared detector. In addition, the dispensing and accountability system includes at least one dispensing unit operatively coupled to the controller, such that the controller is capable of receiving and accounting a second set of information from the at least one dispensing unit. The second set of information relates to a response of the person when reminded of washing the hands. Each dispensing unit of the at least one dispensing unit includes a reservoir for storing a cleansing fluid. Further, the each dispensing unit is adapted to dispense the cleansing fluid from the reservoir onto the hands of the person when the person activates the each dispensing unit on being reminded.

The method further includes detecting the presence of the person by the at least one passive infrared detector. Furthermore, the method includes providing the audio signal generated by the at least one audio signal unit to remind the person to wash the hands when the presence of the person is detected by the passive infrared detector. In addition, the method includes dispensing the cleansing fluid from the reservoir onto the hands of the person when the each dispensing unit is activated by the person being reminded. Moreover, the method includes recording a response of the person when reminded of washing the hands, by the controller.

The dispensing and accountability system assures hand washing in an effective manner, and is configured with a controller for accounting information about washing of a person's hands. Further, the method of the present disclosure is a reliable and an easy-to-use method that assures washing of a person's hands by communicating the need of washing the hands to the person and recording the accomplishment of the task of washing the hands.

These together with the other aspects of the present disclosure, along with the various features of novelty that characterize the present disclosure, are pointed out with particularity in the claims annexed hereto and form a part of the present disclosure. For a better understanding of the present disclosure, its operating advantages, and the specified objects attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

The exemplary embodiments described herein in detail for illustrative purposes are subject to many variations in structure and design. It should be emphasized, however, that the present disclosure is not limited to a particular dispensing and accountability system and a method for assuring washing of a person's hands, as shown and described. It is understood that various omissions and substitutions of equivalents are contemplated as circumstances may suggest or render expedient, but these are intended to cover the application or embodiment without departing from the spirit or scope of the claims of the present disclosure. Also, it is to be understood that the phraseology and terminology used herein are for the purpose of description and should not be regarded as limiting.

The use of "including," "comprising," or "having" and variations thereof herein is meant to encompass the items listed thereafter and equivalents thereof as well as additional items. Further, the terms, "first," "second," and the like, herein do not denote any order, elevation or importance, but rather are used to distinguish one aspect with respect to another. Furthermore, the terms, "a" and "an" herein do not denote a limitation of quantity, but rather denote the presence of at least one of the referenced item. Unless limited otherwise, the terms "coupled," and variations thereof herein are used broadly and encompass direct and indirect couplings.

In one aspect, the present disclosure provides a dispensing and accountability system for assuring proper washing of a person's hands. The dispensing and accountability system assures hand washing in an effective manner, and is configured for communicating the need of washing the hands to the person at appropriate time periods and recording the accomplishment of washing the hands. The term "person" herein may relate to a healthcare worker who, in order to maintain hygiene, needs to wash his/her hands effectively and/or frequently before and/or after conducting examinations or procedures on a patient. The dispensing and accountability system will be explained in detail in conjunction with FIGS. 1 and 2.

Figure 1A:
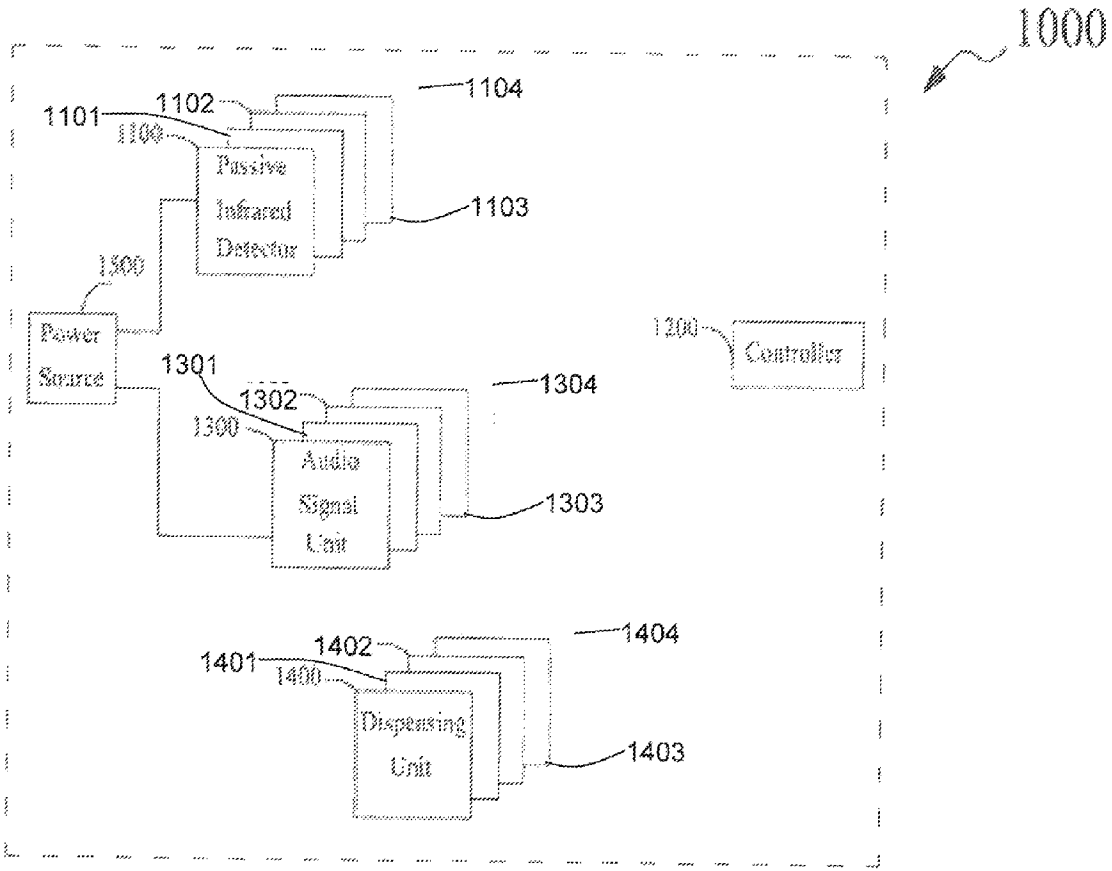
FIG. 1A illustrates an environment depiction of a dispensing and accountability system for assuring washing of a person's hands, in accordance with an embodiment of the present disclosure.
Figure 1B:
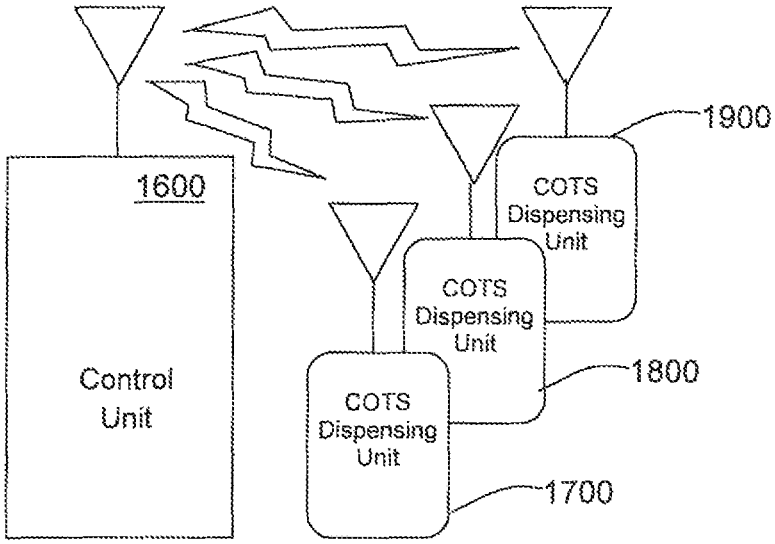
FIG. 1B is a schematic drawing showing another version of the system shown in FIG. 1A.
Figure 1C:
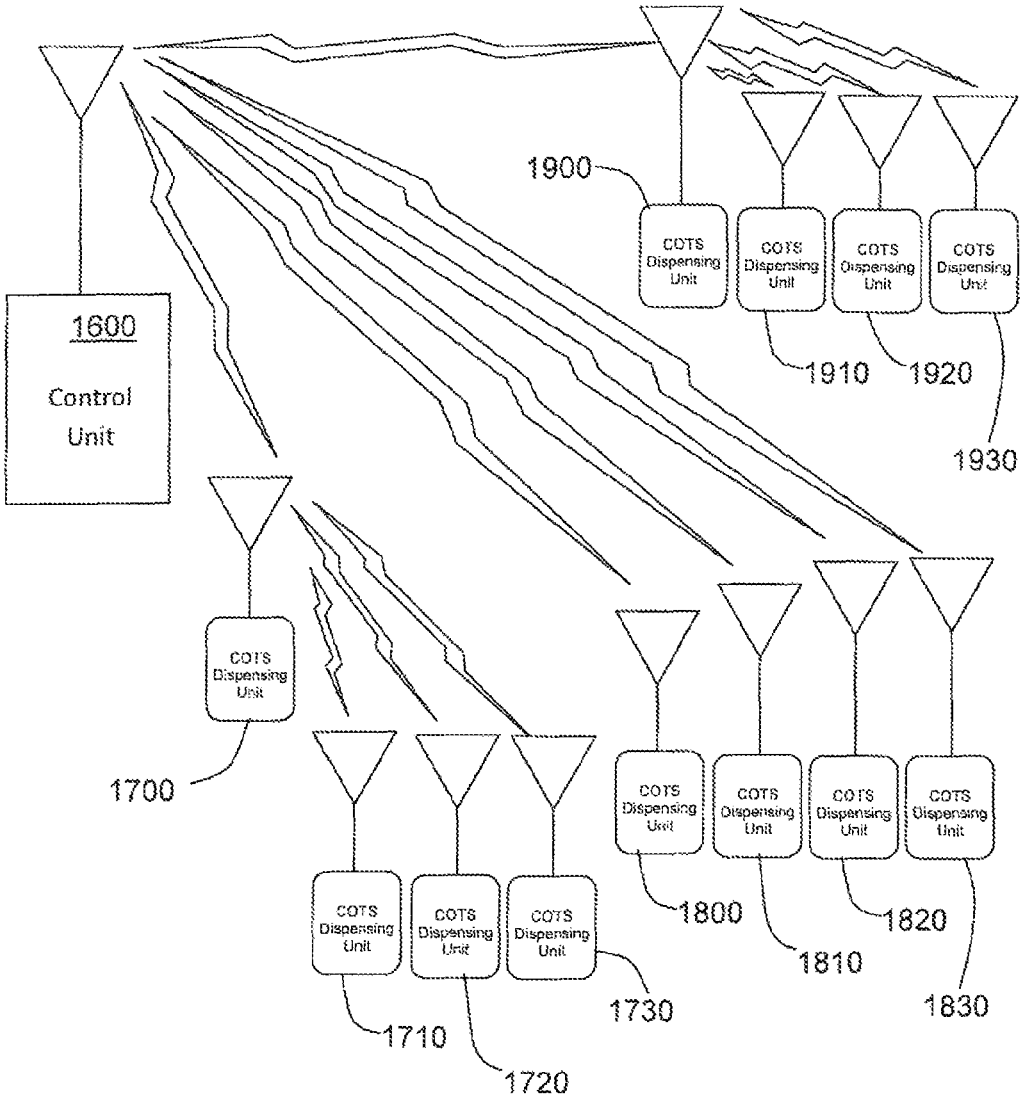
FIG. 1C is a schematic drawing showing an expanded version of the system shown in FIG. 1C.
Figure 2:
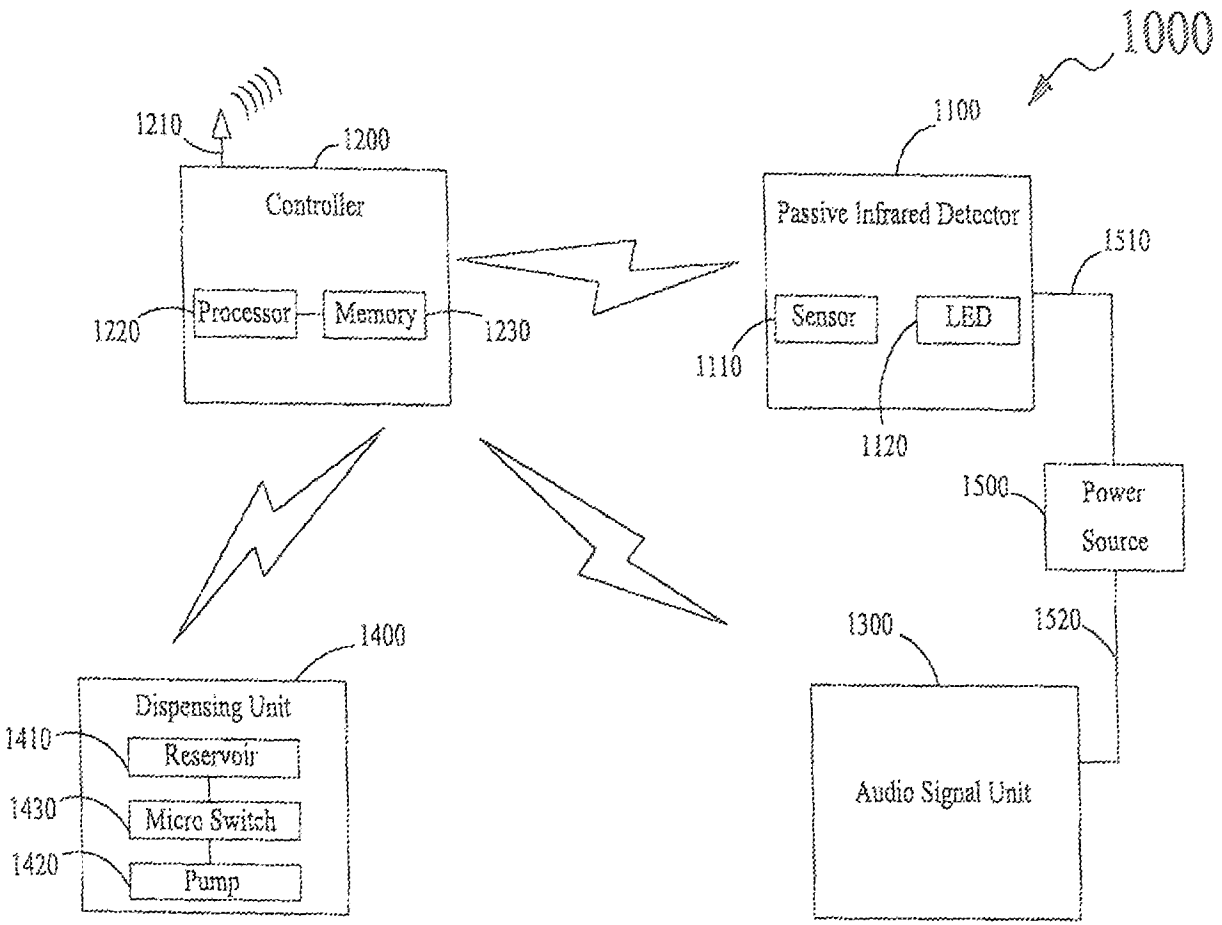
FIG. 2 illustrates a block diagram of the dispensing and accountability system of FIG. 1, in accordance with an embodiment of the present disclosure.

FIG. 1 illustrates an environment depiction of a dispensing and accountability system 1000 (hereinafter referred to as "system 1000"), in accordance with one embodiment of the present disclosure. FIG. 2 illustrates a block diagram of the system 1000. In one form, the environment in which the system 1000 is employed may be a healthcare centre such as a hospital, a clinic, and other healthcare centres that require proper washing of hands before and/or after conducting examinations or procedures on patients.

The system 1000 includes at least one passive infrared detector, such as a passive infrared detector 1100 (hereinafter referred to as "detector 1100"), adapted to detect the presence of a person having a requirement of washing hands, i.e., a person being monitored by the system 1000. In one form, each detector 1100 of the at least one passive infrared detector may be mounted at a specific location, such as a wall of a specific floor of a healthcare centre.

The detector 1100 serves as a motion detector and may detect the presence of the person by measuring infrared light radiated from the body of the person, when the person is in vicinity of the detector 1100. For example, the detector 1100 may detect the presence of the person when the person passes in front of the wall that has the detector 1100 mounted thereon. Further, the detector 1100 includes a sensor 1110 for sensing unique identification characteristics of the person. Such characteristics may be specific to the person and may assist in recognizing the person. Specifically, the characteristics may relate to facial structure, industry standard barcodes, and the like, that are associated with the person. Accordingly, the sensor 1110 may be configured with a Charge-Coupled Device (CCD), a barcode scanner, and such other electronic devices that may assist in scanning the characteristics of the person for identification of the person.

The detector 1100 may further include at least one light emitting diode, such as the light emitting diode (LED) 1120 (hereinafter referred to as "LED 1120"), for generating a visual signal to the person in order to remind the person to wash the hands. Specifically, the LED 1120 emits a light of a specific color, such as red color, which is visible to the person. Such an emission may serve as a visible indication for reminding the person to wash his/her hands. It will be evident that the detector 1100 may include more than one LED 1120 for generating the visual signal.

Further, the system 1000 includes a controller 1200 operatively coupled to the detector 1100 for receiving and accounting a first set of information from the detector 1100 (as shown in FIGS. 1 and 2). The first set of information relates to detection of the presence of the person and characteristics specific to the person for recognizing the identity of the person. Without departing from the scope of the present invention, the controller 1200 may be installed at any other location that is a distance apart from the location of the detector 1100. For example, the controller 1200 may be located within an administration portion of the healthcare centre. Alternatively, the controller 1200 may be installed in vicinity to the detector 1100.

As shown in FIG. 2, the controller 1200 is operatively coupled to the detector 1100 through a wireless connection. Specifically, the controller 1200 may be configured with a wireless interface, such as a Bluetooth interface, for establishing the wireless connection with the detector 1100. Further, the controller 1200 may also include an antenna 1210 for wirelessly receiving and transmitting signals. The antenna 1210 may serve as a receiver and a transmitter for communicating with the detector 1100. It may be evident that the controller 1200 may communicate with the detector 1100 through a complementary transceiver of the detector 1100.

The controller 1200 is in the form of a regular computing unit, for example, a desktop computer, a laptop, a palmtop computer, and the like. The controller 1200 may include a processor 1220 for processing the first set of information. The processor 1220 may operate based on algorithms relating to facial recognition, Radio Frequency (RF) tags, industry standard barcodes and the like, and may be used for identifying different healthcare workers including the person who is required to wash his/her hands. The controller 1200 further includes a memory 1230 operatively coupled to the processor 1220. The memory 1230 is adapted to store data specific for the different healthcare workers including the person who is required to wash his/her hands. Specifically, the memory 1230 may store the data corresponding to the first set of information about the person who is being monitored, and is required to wash his/her hands before and/or after conducting an examination or procedure on a patient. Further, the data stored within the memory 1230 may be updated by the processor 1220 on a regular basis.

It will be evident that the controller 1200 may be implemented with hardware modules, software modules, firmware modules, or any combination thereof without departing from the scope of the present disclosure. Further, the controller 1200 may be implemented with display options. For example, the controller 1200 may include a display screen for displaying specific information relating to the person.

Furthermore, the system 1000 includes at least one audio signal unit, such as an audio signal unit 1300, for generating an audio signal to remind the person to wash the hands. The audio signal unit 1300 is operatively coupled to the controller 1200. Specifically, the audio signal unit 1300 may be coupled wirelessly to the controller 1200. It may be evident that the audio signal unit 1300 may include a receiver for receiving signals from the controller 1200 for activation thereof in order to generate the audio signal. The audio signal is generated when the presence of the person is detected by the detector 1100. In the present embodiment, the audio signal unit 1300 is an audio enunciator such as a buzzer. Alternatively, the audio signal unit 1300 may be an audio enunciator that may announce messages, such as "Please wash your hands". It may be evident that the messages to be announced may be programmed on the memory 1230 of the controller 1200.

Without departing from the scope of the present disclosure, the audio signal unit 1300 may also be operatively coupled to the detector 1100 and may operate directly when the presence of the person is detected by the detector 1100. Further, the audio signal unit 1300 may be mounted adjacent to the detector 1100 at the specific location.

In addition, the system 1000 includes at least one dispensing unit, such as a dispensing unit 1400 (hereinafter referred to as "dispensing unit 1400"), operatively coupled to the controller 1200. Further, the dispensing unit 1400 may also be either coupled to or mounted adjacent to the detector 1100.

The dispensing unit 1400 includes a reservoir 1410 for storing a cleansing fluid for washing the hands. The cleansing fluid may be any type of a sanitizing fluid. Specifically, the cleansing fluid is an alcohol-based hand cleansing fluid.

The dispensing unit 1400 is adapted to dispense the cleansing fluid from the reservoir 1410 onto the hands of the person when the person activates the dispensing unit 1400 on being reminded of washing the hands. The dispensing unit 1400 further includes a pump 1420 attached to the reservoir 1410 and operated by the person for activating the dispensing unit 1400 in order to withdraw the cleansing fluid from within the reservoir 1410 onto the hands of the person. Accordingly, the pump 1420 is a manual pump. Further, the dispensing unit 1400 includes a micro switch 1430 adapted to regulate the pump 1420. The micro switch 1430 may be an actuation detection micro switch.

The dispensing unit 1400 is wirelessly coupled to the controller 1200, where the controller 1200 is capable of wirelessly receiving and then accounting a second set of information from the dispensing unit 1400. Specifically, the antenna 1210 of the controller 1200 may communicate with the dispensing unit 1400 for receiving the second set of information. Accordingly, the dispensing unit 1400 may also have a transceiver for communicating with the controller 1200. The second set of information relates to a response of the person when reminded of washing the hands. The response of the person may be washing the hands. Alternatively, the response may be rendering the hands unwashed.

Moreover, the system 1000 includes a power source 1500 electrically coupled to the detector 1100 and the audio signal unit 1300 for supplying power to the detector 1100 and the audio signal unit 1300. Specifically, the power source 1500 may be electrically coupled to the detector 1100 through a wire 1510. Further, the power source 1500 may be electrically coupled to the audio signal unit 1300 through a wire 1520. In another form of the present embodiment, the detector 1100, the audio signal unit 1300, and the dispensing unit 1400 may be manufactured as a single unit portable structure. The controller 1200 may wirelessly communicate with the single unit portable structure including the detector 1100, the audio signal unit 1300, and the dispensing unit 1400. Accordingly, the person may carry the single unit portable structure and may wash his/her hands when reminded by the system 1000 before and/or after conducting examinations and/or procedures on a patient. The invention also includes a core architecture and implementation that is designed to enhance current Commercial Off The Shelf (COTS) dispensing units that may already be deployed by various institutions. This result is achieved by utilizing Scalable Processor Architectures and Real-Time Analysis combined with Symmetrical Multiple Processing (SMP) which is inherent in the core controller 1200. This approach allows for the quick and cost effective integration of current as well as future sensors which are specifically designed or adaptable to the detection of bacteria or chemicals which have been deemed harmful to life. Referring, for example, to FIG. 1, passive infrared detectors 1102 and 1103 have been added to the system 1000. Detector 1103 is a Commercial Off The Shelf (COTS) dispensing unit which was in use in another part of the institution, but which may be added to the system because of the scalable capabilities of the core controller 1200. Detector 1104 is a new dispensing unit which is added to the system because of a need to expand the system, for example, to a newly added wing of the institution. Similarly, audio signal units 1301 and 1302 have been added to the system. Audio signal unit 1303 is a Commercial Off The Shelf (COTS) audio signal unit which was in use with the detector 1103 in another part of the institution, but which may be added to the system because of the scalable capabilities of the core controller 1200. Audio signal unit 1304 is a new audio signal unit which is used in conjunction with detector 1104 because of a need to expand the system, for example, to a newly added wing of the institution. Similarly, dispensing units 1401 and 1402 have been added to the system. Dispensing unit 1403 is a Commercial Off The Shelf (COTS) dispensing unit which was use in use with the detector 1103 and audio signal unit 1303 in another part of the institution, but which may be added to the system because of the scalable capabilities of the system. Dispensing unit 1404 is a new audio signal unit which is used in conjunction with detector 1104 and audio signal unit 1304 because of a need to expand the system, for example, to a newly added wing of the institution.

This scalable approach is designed to grow as the institution's requirements grow. This result is achieved by the core architecture supporting a software approach which allows for the integration of additional sensors and/or dispensers as the institution expands without disruption to the core infrastructure. Additional sensors such as infrared (long-wave and short-wave) may be added as visual detection and identification purposes human features or the presence of colonized bacteria. Referring, for example, to FIG. 1B, a basic installation as described above would include a control unit 1600 and dispensing units 1700, 1800, and 1900. As described above the dispensing units are each also used in conjunction with a motion detector and an audio signal unit (not shown). Referring to FIG. 1C, it will be seen that in addition to the motion detectors, other sensors may be added to the system either on installation or after installation to be used in conjunction with the dispensing units. It will be seen that the control unit 1610 is wirelessly connected to dispensing units 1710 (used in conjunction with a motion detector and audio signal unit) and to photographic detection sensor 1720, radiation detection sensor 1730, and biological detection sensor 1740. Control unit 1610 is also wirelessly connected to dispensing unit 1810 (used in conjunction with a motion detector and audio signal unit) and to photographic detection sensor 1820, radiation detection sensor 1830, and biological detection sensor 1840. Control unit 1610 is also connected to dispensing unit 1910 (used in connection with a motion detector and audio signal unit) and to photographic detection sensor 1920, radiation detection sensor 1930, and biological detection sensor 1940.

The additional sensors described above with the capability of detecting the presence of harmful substances such as biochemicals used in warfare as well as numerous other sensors including but not limited to detection of radioactive substances and poisonous gases may be particularly useful in systems used in military field hospitals.

Figure 3:
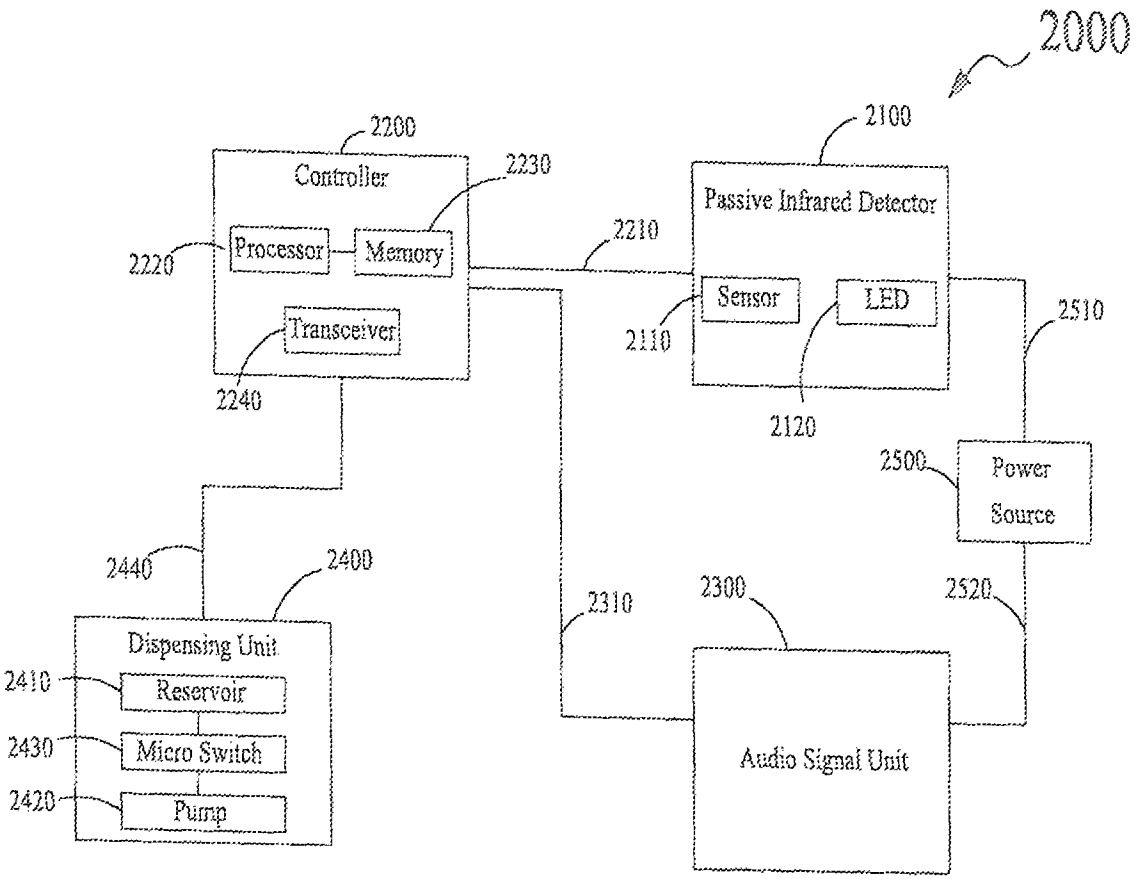
FIG. 3 illustrates a block diagram of a dispensing and accountability system for assuring washing of a person's hands, in accordance with another embodiment of the present disclosure.

FIG. 3 illustrates a dispensing and accountability system 2000 (hereinafter referred to as "system 2000"), in accordance with another embodiment. The system 2000 is similar to the system 1000. Specifically, the system 2000 includes at least one passive infrared detector 2100 (hereinafter referred to as "detector 2100") similar to the detector 1100. The detector 2100 includes a sensor 2110 and a light emitting diode (LED) 2120 (hereinafter referred to as "LED 2120"). Further, the system 2000 includes a controller 2200 similar to the controller 1200. However, the controller 1200 is operatively coupled to the detector 2100 through a wired connection, via a wire 2210. Specifically, the controller 2200 may be configured with an Ethernet interface for establishing the wired connection with the detector 2100. Alternatively, the controller 2200 may be configured with any other interface for establishing the wired connection. Further, the controller 2200 includes a processor 2220, a memory 2230, and a transceiver 2240.

The system 2000 also includes at least one audio signal unit, such as an audio signal unit 2300, similar to the audio signal unit 1300. The audio signal unit 2300 is operatively coupled to the controller 2200 via a wire 2310.

In addition, the system 2000 includes at least one dispensing unit 2400 (hereinafter referred to as "dispensing unit 2400") similar to the dispensing unit 1400. The dispensing unit 2400 includes a reservoir 2410, a pump 2420, and a micro switch 2430. The dispensing unit 2400 is operatively coupled to the controller 2200 through a wired connection, such as a wire 2440. Accordingly, the dispensing unit 2400 is capable of sending a second set of information to the controller 2200, where the second set of information relates to response of the person when reminded of washing the hands. It may be evident that the dispensing unit 2400 may include a transceiver for communicating with the controller 2200.

Moreover, the system 2000 includes a power source 2500 similar to the power source 1500. The power source 2500 is adapted to supply power to the detector 2100 through a wire 2510 and to the audio signal unit 2300 through a wire 2520.

In another aspect, the present disclosure provides a method for assuring washing of a person's hands using the dispensing and accountability system, such as systems 1000 and 2000. The method will be explained using the system 1000 for the sake of brevity. Accordingly, reference will be made to FIGS. 1 and 2 for description of the method of the present disclosure. However, it should be evident that the method for assuring washing of a person's hands may be performed while utilizing the system 2000.

Figure 4:
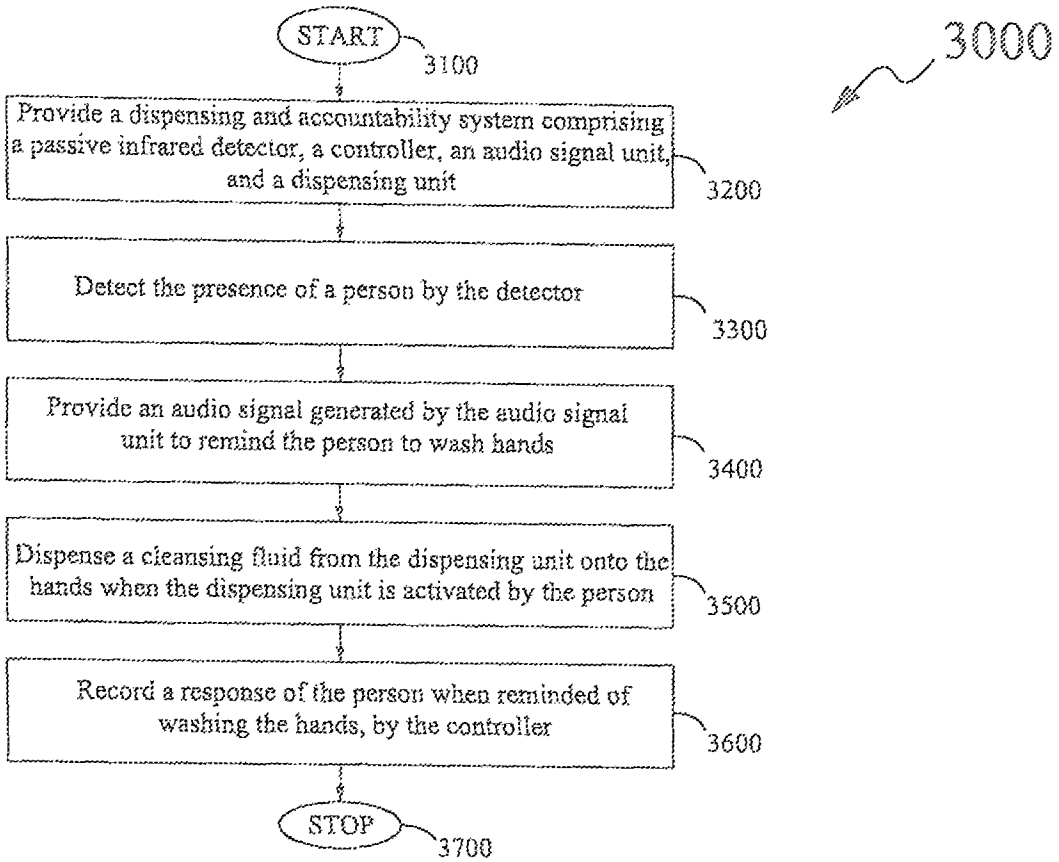
FIG. 4 illustrates a flow diagram of a method for assuring washing of a person's hands, in accordance with an embodiment of the present disclosure.

FIG. 4 illustrates a method 3000 for assuring washing of a person's hands. The method 3000 starts at 3100. At 3200, the system 1000 is provided. At 3300, the presence of the person is detected by the detector 1100. Specifically, the unique characteristics specific to the person to be monitored are sensed and scanned with the help of the sensor 1110 using the CCD or the barcode scanner. Subsequently, the detector 1100 wirelessly sends the first set of information to the controller 1200. The processor 1220 of the controller 1200 then processes the first set of information for relating the first set of information to the data stored in the memory 1230. Subsequently, the antenna 1210 of the controller 1200 transmits requisite signals to the audio signal unit 1300 for activation thereof for generating an audio signal. Alternatively, the processor 1220 may send a message programmed on the memory 1230 to the audio signal unit 1300 for announcing the message. Further, the antenna 1210 of the controller 1200 may also transmit requisite signals to the detector 1100 for activation of the LED 1120 once the processor 1220 processes the first set of information, identifies the person, and determines whether the person needs to wash his/her hands or not.

At 3400, the audio signal generated by the audio signal unit 1300 is provided to remind the person to wash the hands, when the presence of the person is detected by the detector 1100. Further, a visual signal generated by the LED 1120 may be provided in order to remind the person to wash the hands. Subsequent to reminding, the cleansing fluid from the reservoir 1410 of the dispensing unit 1400 is dispensed onto the hands of the person when the person activates the dispensing unit 1400, at 3500. Further, the audio signal may be regenerated when the person does not activate the dispensing unit 1400 even on being reminded of washing the hands. Furthermore, the audio signal may be regenerated again and again till a time period when the person activates the dispensing unit 1400 for washing the hands. Accordingly, the method 3000 assures washing of the person's hands.

At 3600, a response of the person when reminded of washing the hands by the controller 1200 is recorded and stored in the memory 1230. In one form, the response of the person relates to washing the hands. Subsequently, the response of the person may also be displayed on the display screen of the controller 1200. Accordingly, the method 3000 assists in maintaining an updated account of hand washing for the person. Further, the recorded response of the person serves as an evidence of accomplishment of the task of washing the hands before and/or after conducting examinations and/or procedures on a patient. The method 3000 stops at 3700.

In another form, the response of the person may relate to rendering the hands unwashed in case the person does not desire to wash his/her hands even on receiving regular reminders. Accordingly, the method 3000 may assist in maintaining an updated account of the person in case the person has not washed his/her hands before and/or after conducting examinations and/or procedures on a patient.

The present disclosure provides a dispensing and accountability system, such as the systems 1000 and 2000, for assuring hand washing in an effective manner. Further, the dispensing and accountability system is configured with a provision of accountability of responses of a targeted person before and/or after conducting examinations and/or procedures on a patient. The dispensing and accountability system serves as a tool to keep a check on spreading of diseases by assuring hand washing by healthcare workers with the help of audio and visual signaling reminders. In addition, the present disclosure provides a method, such as the method 3000, which is a reliable and easy-to-use method for assuring washing of a person's hands by communicating the need of washing the hands to the person and recording the accomplishment of the task of washing the hands.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A dispensing and accountability system for assuring washing of a person's hands, the dispensing and accountability system comprising:

at least one passive infrared detector adapted to detect the presence of the person having a requirement of washing the hands;

a controller having a scalable processor architecture operatively coupled to each passive infrared detector of the at least one passive infrared detector for receiving and accounting a first set of information from the each passive infrared detector, wherein the first set of information relates to detection of the presence of the person;

at least one audio signal unit operatively coupled to the controller, the at least one audio signal unit adapted to generate an audio signal to remind the person to wash the hands, wherein the audio signal is generated when the presence of the person is detected by the at least one passive infrared detector; and at least one dispensing unit operatively coupled to the controller, such that the controller is capable of receiving and accounting a second set of information from the at least one dispensing unit, the second set of information relating to a response of the person when reminded of washing the hands;

wherein each dispensing unit of the at least one dispensing unit comprises a reservoir for storing a cleansing fluid and is adapted to dispense the cleansing fluid from the reservoir onto the hands of the person when the person activates the each dispensing unit on being reminded and wherein because the controller has the scalable processor architecture, each of the at least one passive infrared detectors, each of the at least one audio signal units, and each of the at least one cleansing fluid dispensing units can be easily added or removed from the system.

2. The dispensing and accountability system of claim 1, wherein the each passive infrared detector of the at least one passive infrared detector comprises at least one light emitting diode for generating a visual signal in order to remind the person to wash the hands.

3. The dispensing and accountability system of claim 1, wherein the each dispensing unit of the at least one dispensing unit further comprises, a pump attached to the reservoir and operated by the person for activating the each dispensing unit in order to withdraw the cleansing fluid from within the reservoir onto the hands of the person; and a micro switch adapted to regulate the pump.

4. The dispensing and accountability system of claim 1, wherein the at least one audio signal unit is an audio enunciator.

5. The dispensing and accountability system of claim 1, wherein the controller is operatively coupled to the each passive infrared detector of the at least one passive infrared detector through one of a wired connection and a wireless connection.

6. The dispensing and accountability system of claim 1, wherein the each dispensing unit of the at least one dispensing unit is operatively coupled to the controller through one of a wired connection and a wireless connection.

7. The dispensing and accountability system of claim 1, further comprising at least one power source for supplying power to the at least one passive infrared detector and the at least one audio signal unit.

8. The dispensing and accountability system of claim 1, wherein the each passive infrared detector comprises a sensor for sensing characteristics of the person.

9. The dispensing and accountability system of claim 1, wherein the controller is a computing unit comprising a processor for processing the first set of information, and a memory operatively coupled to the processor, the memory adapted to store data corresponding to the first set of information.

10. The dispensing and accountability system of claim 1, wherein the response of the person is one of washing the hands and rendering the hands unwashed.

11. The dispensing and accountability system of claim 1, wherein the cleansing fluid is an alcohol-based hand cleansing fluid.

12. A method for operating a system for assuring washing of a person's hands, the method comprising:

providing a dispensing and accountability system, the dispensing and accountability system comprising, at least one passive infrared detector adapted to detect the presence of the person having a requirement of washing the hands, a controller having a scalable processor architecture and operatively coupled to each passive infrared detector of the at least one passive infrared detector for receiving and accounting a first set of information from the each passive infrared detector, wherein the first set of information relates to detection of the person, at least one audio signal unit operatively coupled to the controller, the at least one audio signal unit adapted to generate an audio signal to remind the person to wash the hands, wherein the audio signal is generated when the presence of the person is detected by the at least one passive infrared detector, at least one dispensing unit operatively coupled to the controller, such that the controller is capable of receiving and accounting a second set of information from the at least one dispensing unit, the second set of information relating to a response of the person when reminded of washing the hands, wherein each dispensing unit of the at least one dispensing unit comprises a reservoir for storing a cleansing fluid and adapted to dispense the cleansing fluid from the reservoir onto the hands of the person;

detecting the presence of the person by the at least one passive infrared detector;

providing the audio signal generated by the at least one audio signal unit to remind the person to wash the hands when the presence of the person is detected by the passive infrared detector;

dispensing the cleansing fluid from the reservoir onto the hands of the person when the each dispensing unit is activated by the person being reminded;

recording a response of the person when reminded of washing the hands, by the controller;

adding to or deleting from the system at least one passive infrared detector, at least one audio signal unit, or at least one cleansing fluid dispensing unit.

13. The method of claim 12, wherein the each passive infrared detector comprises at least one light emitting diode.

14. The method of claim 13, further comprising providing a visual signal generated by the at least one light emitting diode in order to remind the person to wash the hands.

15. The method of claim 12, wherein the controller is a computing unit comprising a processor for processing the first set of information, and a memory operatively coupled to the processor, the memory adapted to store data corresponding to the first set of information.

16. The method of claim 12, wherein the each dispensing unit of the at least one dispensing unit further comprises, a pump attached to the reservoir and operated by the person for activating the each dispensing unit in order to withdraw the cleansing fluid from within the reservoir onto the hands of the person; and a micro switch adapted to regulate the pump.

17. The method of claim 12, wherein the dispensing and accountability system further comprises at least one power source for supplying power to the at least one passive infrared detector and the at least one audio signal unit.

18. The method of claim 12, wherein the each passive infrared detector comprises a sensor operatively coupled to the controller.

19. The method of claim 18, further comprising sensing characteristics of the person by the sensor.

* * * * *